US008474634B1

(12) United States Patent
Branson et al.

(10) Patent No.: US 8,474,634 B1
(45) Date of Patent: Jul. 2, 2013

(54) CHILD RESISTANT CLOSURE WITH VENTS

(75) Inventors: Mark K. Branson, Newburgh, IN (US); Brian J. Brozell, Maumee, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 505 days.

(21) Appl. No.: 12/770,843

(22) Filed: Apr. 30, 2010

(51) Int. Cl.
*B65D 55/02* (2006.01)
*B65D 53/00* (2006.01)
*B65D 51/00* (2006.01)

(52) U.S. Cl.
USPC ..... 215/220; 215/219; 215/341; 215/230

(58) Field of Classification Search
USPC ..... 215/341, 217–221, 230, 204
See application file for complete search history.

(56) References Cited

U.S. PATENT DOCUMENTS 3,422,978 A 1/1969 Quackenbush
3,679,085 A 7/1972 Gach
3,685,676 A 8/1972 Gach et al.
3,797,688 A 3/1974 Porcelli et al.
3,820,676 A 6/1974 Mucsi
3,857,505 A 12/1974 Mumford et al.
3,944,102 A * 3/1976 Grau ..... 215/251
4,311,255 A 1/1982 Meshberg
4,319,690 A 3/1982 Birrell et al.
4,523,688 A 6/1985 Puresevic et al.
4,854,459 A 8/1989 DeJonge
5,020,681 A 6/1991 Kusz
5,147,052 A * 9/1992 Minette ..... 215/215
5,280,842 A 1/1994 Koo
6,426,046 B1 7/2002 Cassells et al.

FOREIGN PATENT DOCUMENTS

FR 2677614 A1 12/1992

* cited by examiner

*Primary Examiner* — Robin Hylton
(74) *Attorney, Agent, or Firm* — Middleton Reutlinger; Chad D. Bruggerman; John F. Salazar

(57) ABSTRACT

A child resistant closure having an outer cap and an inner cap each of which has a base wall on a peripheral skirt with sets of lugs on the inner surface of the outer closure member and on the outer surface of the inner closure member which are adapted to be engaged when the members are moved axially toward one another. The outer surface of the inner cap is provided with a plurality of vents to allow for increased evacuation of fluid between the inner and outer cap.

20 Claims, 7 Drawing Sheets

CHILD RESISTANT CLOSURE WITH VENTS

TECHNICAL FIELD

The present invention relates to a child resistant closure and particularly to a child resistant closure with vents.

DETAILED DESCRIPTION

Figure 1:
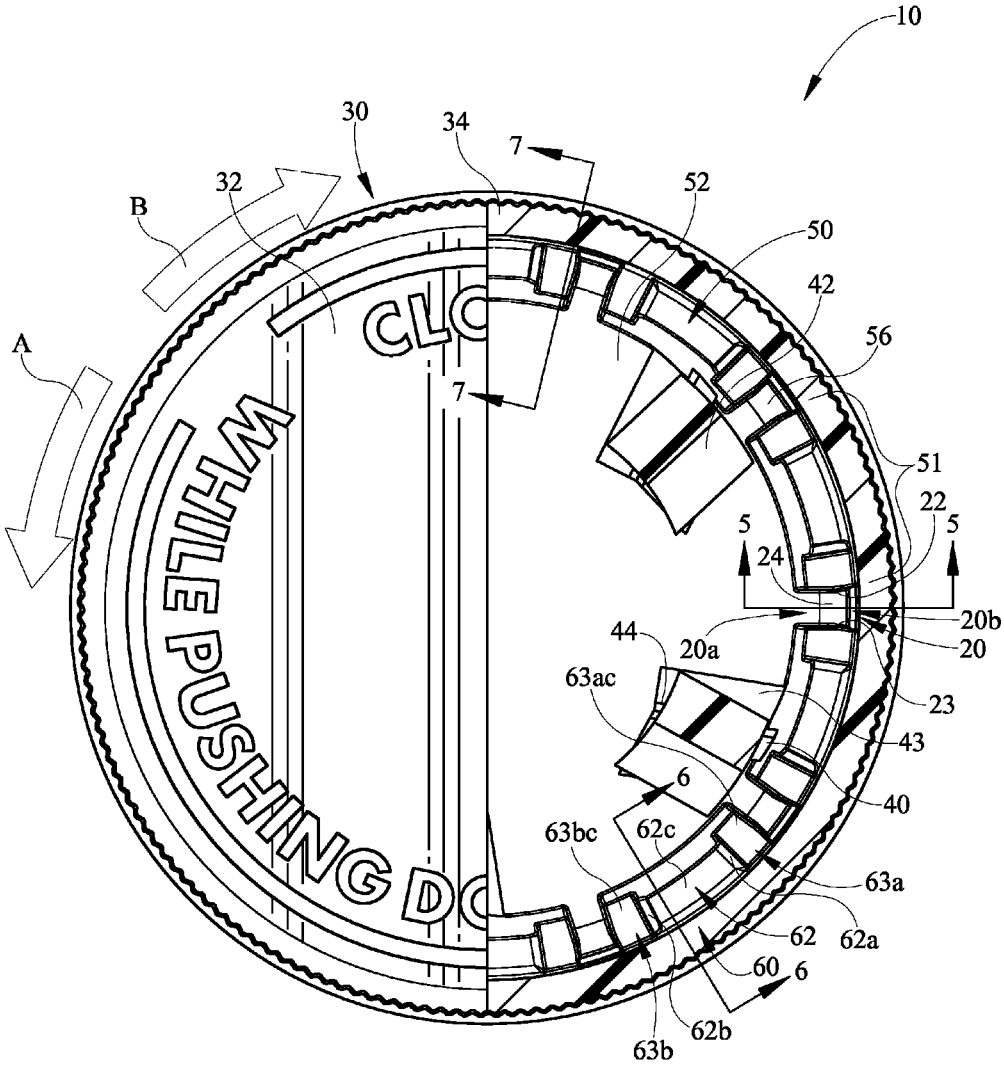
FIG. 1 is a top view of the closure according to one embodiment with portions of the outer cap partially broken away.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Child resistant closure 10 according to one embodiment of the present invention depicted in the FIGS. 1-7 has an outer cap 30 and an inner cap 50 structured to provide at least one adequate child resistant mechanism and the evacuation of fluid between the inner and outer caps. The child resistant mechanism discourages access to the contents of the container by children and others unable to recognize the danger. Child resistant closure 10 is provided with inner cap 50 and outer cap 30 permitting closing of a container by turning the caps as a unit in the closure-applying direction B but which permit relative rotation in an opening or closure-removing direction A thereby precluding removal of the closure. In addition to rotation, removal requires axial deflection of one cap relative to the other to engage complementary driving elements permitting rotation of the caps as a unit and therefore removal from a container.

The child resistant closure 10 is designed for products that are highly sensitive to moisture and need to have the package leak tested after the capping and induction sealing to ensure an adequate seal has occurred. Packages are inspected for leaks on the fill line in a vacuum decay, nitrogen flushing, leak detection chamber. Previous child resistant closures have a nesting engagement that includes a continuous retaining bead on each of the inner cap and outer cap that are capable of creating a seal that may not allow air or fluid trapped between the outer and inner caps to evacuate quickly. This air that remains trapped between the caps results in a high level of false rejects at the leak detection chamber at fast assembly line speeds. To remedy this inadequacy, the present embodiments of the inner cap includes one or more vents or vent channels on the exterior surface that axially run the entire height or axial distance of the side wall and extends over the inner cap top wall. These vents create an open path between the inner cap and the continuous retention bead of the outer cap to lessen any chance of an unwanted seal. Therefore, air or fluid trapped between the outer and inner caps can evacuate quickly through these vents during the initial vacuum pull in the leak chamber, thereby reducing the level of false rejects at fast line assembly speeds.

Figure 2:
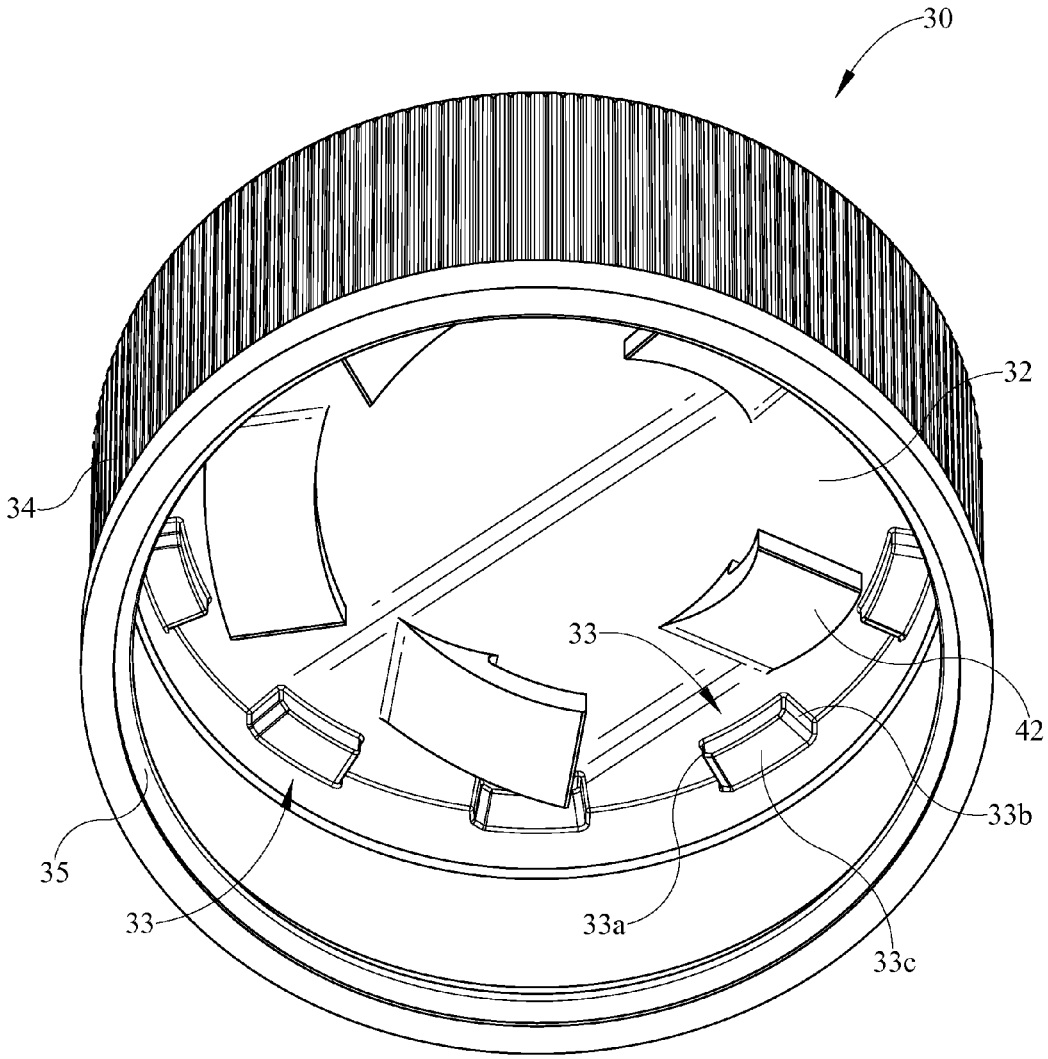
FIG. 2 is a bottom perspective view of the outer cap of the closure of FIG. 1.
Figure 4:
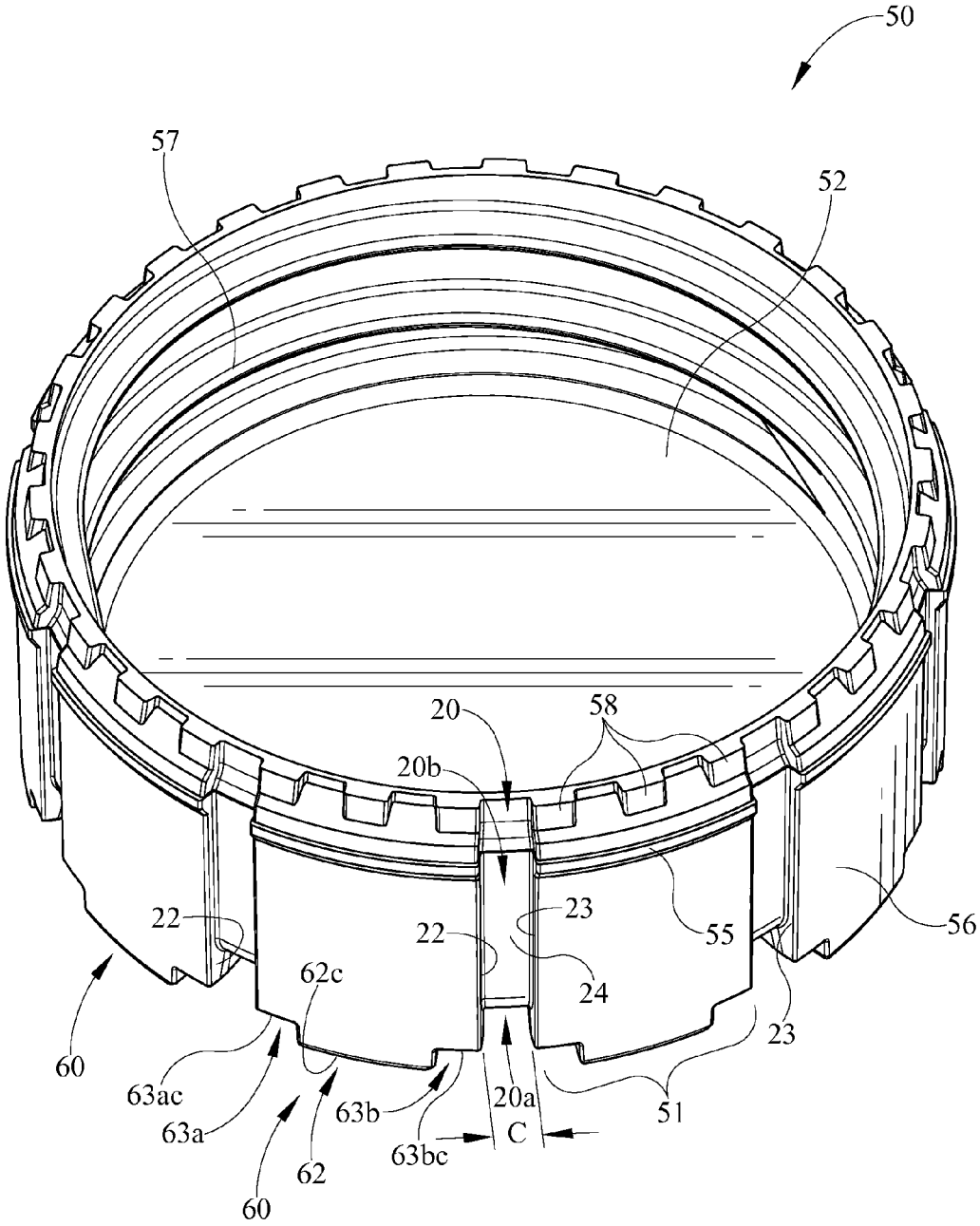
FIG. 4 is a bottom perspective view of the inner cap of the closure of FIG. 1.

Referring to the drawings, the child resistant closure 10 includes outer cap 30 and inner cap 50 which are telescoped in assembled relationship with the inner cap extending into outer cap and retained therein by a continuous retaining bead 35 (FIG. 2). Closure 10 is adapted to be applied to the neck of a container (not shown) which has container threads that are engaged by threads 57 on the inner surface of the peripheral wall or skirt 56 of the inner cap (FIG. 4). Inner cap 50 is formed with a plurality or circumferentially spaced lugs 60 that are adapted to be engaged by lugs 33 on the inner surface of the top wall 32 of the outer cap. A plurality of ramps 40 are provided and circumferentially spaced relationship on the upper surface of a top wall 52 of the inner cap 50 and are generally V-shaped and have an abutting surface 44. Integral spring fingers 42 extend in circumferentially spaced relationship from the inner surface of top wall 32 of outer cap 30.

The aforementioned construction functions such that the closure 10 is applied to a container, rotation of outer cap 30 in the closure-applying direction B will cause spring fingers 42 to engage the abutting surfaces 44 of ramps 40 of inner cap 50, and rotation in the opposite or closure-removing direction A will cause the spring fingers 42 to slip over or ride over the ramps 40. When outer cap 30 is rotated and at the same time forced axially toward inner cap 50 against the action of spring fingers 42, lugs 60 of the inner cap 50 become engaged with lugs 33 of the outer cap 30 so that closure 10 can be unthreaded from the container.

In accordance with the embodiment, a depression or recess 43 that is generally radial is associated with each ramp 40 adjacent its abutting surface 44 so that when spring fingers 42 are in engagement with ramps 40, the distal free end of each finger 42 extends into the recesses 43 and hold the outer cap 30 away from the inner cap 50 at the same time fingers 42 orient the outer cap 30 relative to the inner cap 50 such that the bottom surface 33*c* of lugs 33 on the outer cap 30 are axially aligned with the upper surface 62*c* of lugs 60 on the inner cap 50 and prevent any top load on the package from being applied to spring fingers 42. As a consequence, axial loads such as those that would be encountered if containers are stacked one upon the other are absorbed by lugs 33 and 60 so that there is no deformation of the relatively deflectable outer cap 30.

Although the container is not shown in detail, the container may generally have an elongated cylindrical shape, but it is not limited to such and may be of a variety of shapes that best contain the product or have the greatest aesthetic appeal. The container may have a shoulder narrowing to a container neck finish including a neck that is of sufficient length to accommodate an external thread for threaded engagement of child resistant closure 10 with the container. At the top of the neck is an opening surrounded by a rim permitting access to the contents of the container. The container may be of unitary construction and made of any of numerous materials commonly known in the art depending on specific product and environmental conditions. Some common examples of materials include but are not limited to polyethylene, polypropylene, and polyethylene terephthalate. The container described above is merely representative of containers in general, and it is to be understood that there are a variety of containers of different shape, size, and neck finish that may be used with the push and turn closure embodiments herein.

As shown in FIGS. 1, 2, and 5-7, closure 10 includes outer cap 30. Outer cap 30 has top wall 32 and a peripheral or depending skirt or wall 34 therearound. As shown in FIGS. 2 and 5-7, skirt 34 has a radially inwardly directed continuous retaining bead or rim 35 shaped to hold inner cap 50 within outer cap 30 after assembly. One or more lugs 33 may project from top wall 32 or interconnect with top wall 32 and skirt 34 of outer cap 30. However, a plurality of lugs 33 may be arranged about the inner circumference of cap skirt 34. Each lug 33 of outer cap 30 may include an on-drive surface 33*b* and an off-drive surface 33*a* with a bottom surface 33*c* therebetween.

As shown in FIGS. 1 and 3-7, closure 10 also includes inner cap 50. Inner cap 50 includes top wall 52 with a peripheral or depending skirt or wall 56 therearound. In addition, inner cap 50 may include a sealing liner 80 (FIGS. 5-7) for sealing against the rim of the container (not shown) when closure 10 is engaged therewith. An interior surface of inner cap 50 includes an internal thread 57 for cooperatively engaging the threaded neck of the container. A plurality of lugs 60 are formed on the outer or upper surface of top wall 52 extending generally axially therefrom. Each lug 60 may include a center portion 62 and one or more lateral portions 63*a*, 63*b*. Center portion 62 extends axially further away from top wall upper surface than the lateral portions 63*a* and 63*b*. Center portion 62 of lug 60 includes an upper surface 62*c* and opposing side surfaces 62*a* and 62*b*. Lugs 60 are uniformly spaced circumferentially about inner cap 50. Inner cap 50 is sized to be disposed within outer cap 30 and retained therein by bead 35. Skirt 56 of inner cap 50 is somewhat shorter than skirt 34 of outer cap 30, so that limited axial displacement is possible between the inner cap and the outer cap. The inner cap 50 and outer cap 30 are disposed concentrically in nested relationship and the skirt 34 is provided with a radially inwardly directed bead 35 which is engageable with a radially outwardly extending flange or bead 55 on inner cap 50 to permit limited axial movement of the outer cap 30 and inner cap 50 but maintain them in assembled and nested relationship. Lugs 33 of outer cap 30 are shaped for operable engagement with lugs 60 of inner cap 50. However, because of the loose mounting of inner cap 50 within outer cap 30, outer cap 30 may be rotated with respect to inner cap 50 without interengagement of their respective lugs 33 and 60 when the closure members are sufficiently axially displaced from each other.

Figure 5:
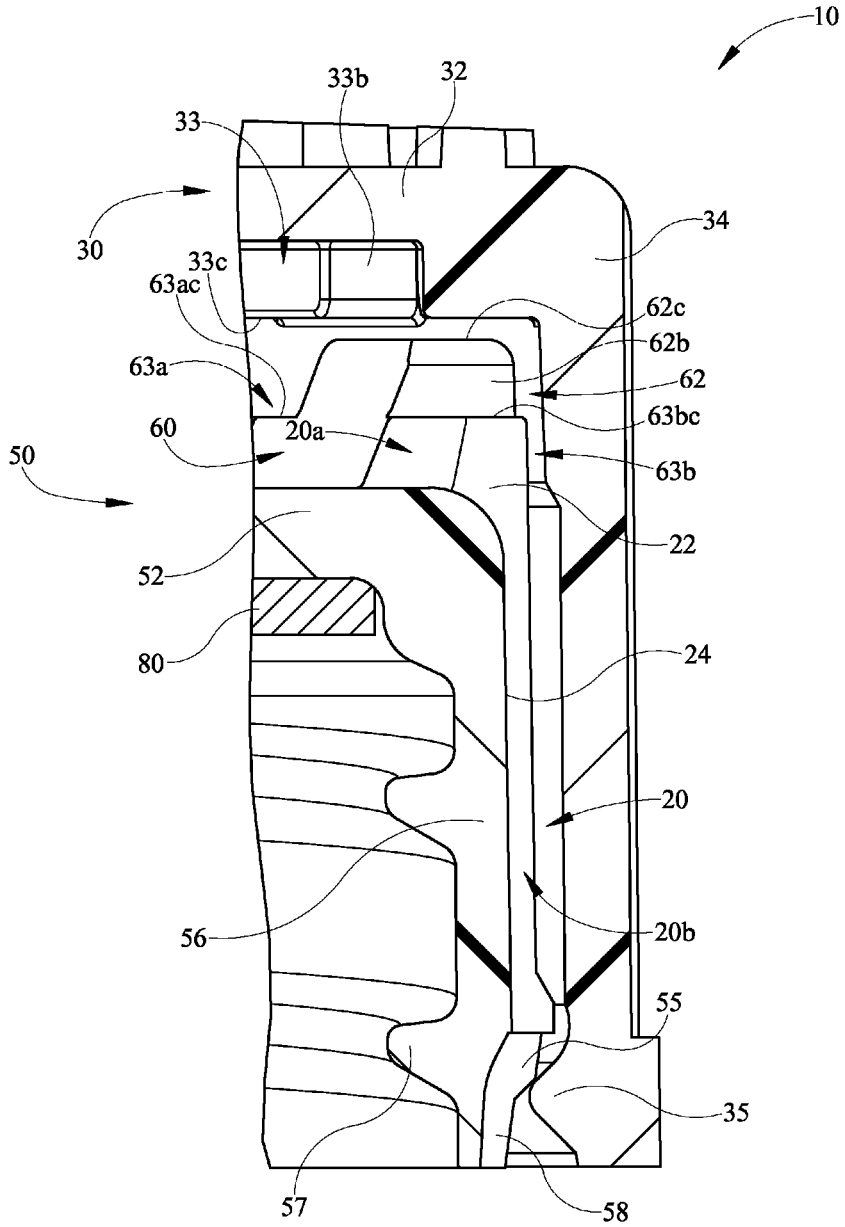
FIG. 5 is an enlarged sectional view of the inner cap and outer cap of the closure of FIG. 1 taken along line 5-5.
Figure 6:
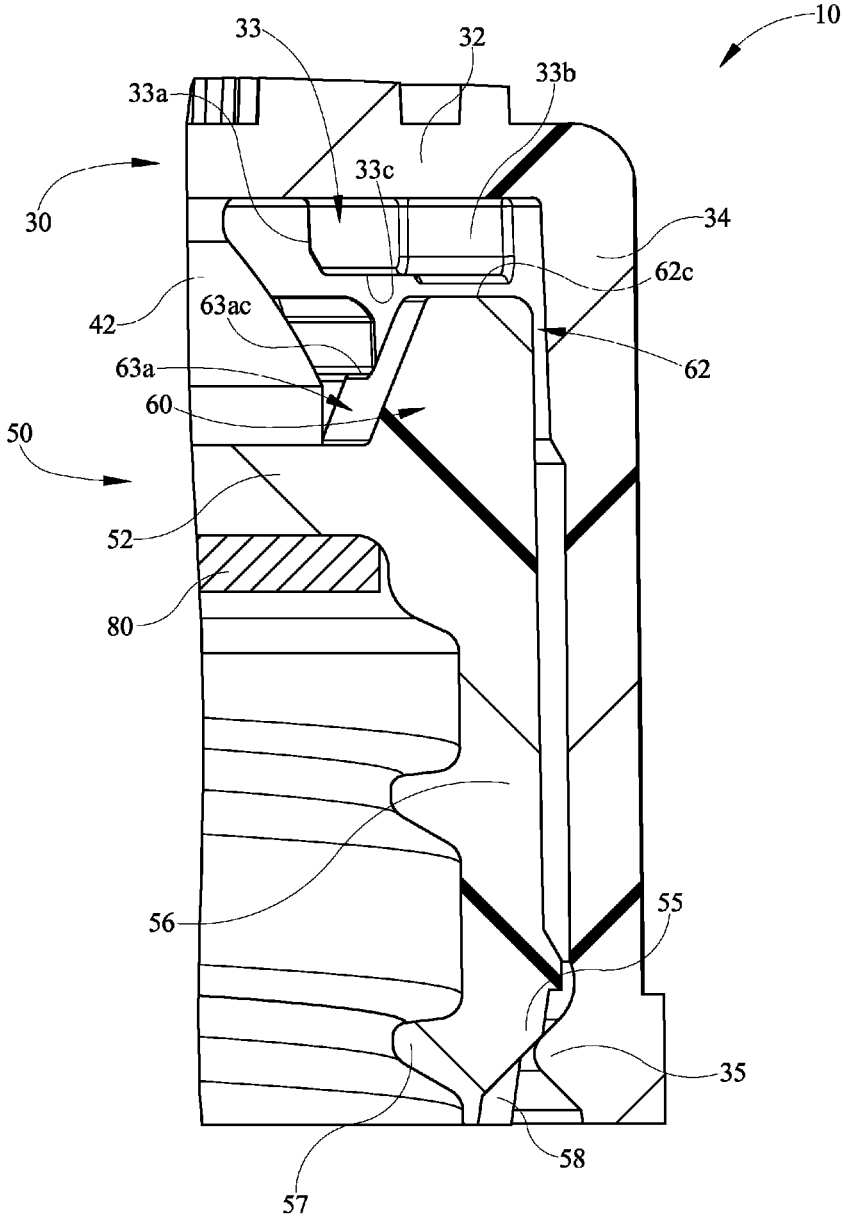
FIG. 6 is an enlarged sectional view of the inner cap and outer cap of the closure of FIG. 1 taken along line 6-6.
Figure 7:
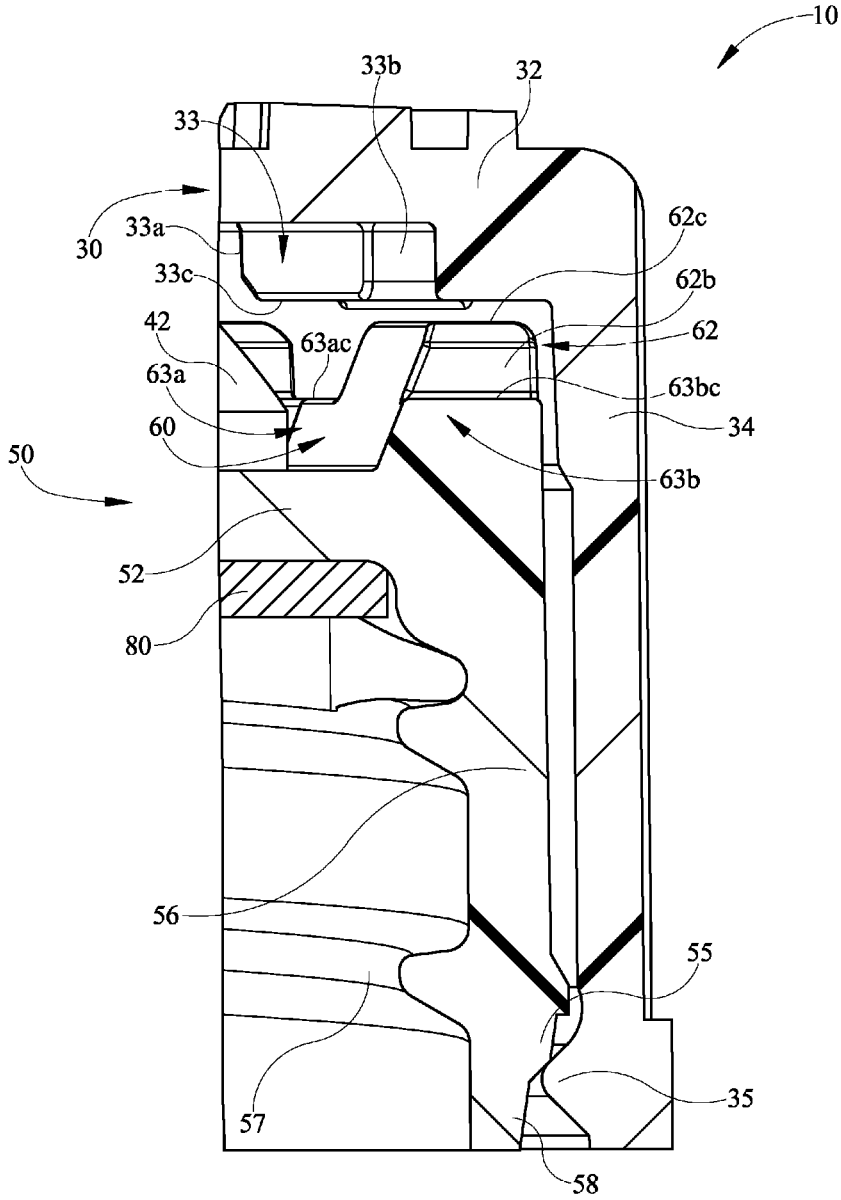
FIG. 7 is an enlarged sectional view of the inner cap and outer cap of the closure of FIG. 1 taken along line 7-7.

As shown in FIGS. 5-7, a sealing member or liner 80 is sized to nest against the inner surface of top wall 52 of inner cap 50. Liner 80 acts as a seal between closure 10 and the rim of the container neck finish when closure 10 is engaged with the neck finish of the container. Various types of liners 80 may be used including re-seal liners, liners made of malleable seal materials or air permeable materials, foil seals, or other seals known to those skilled in the art. Alternatively, a plug seal (not shown) may depend from the interior surface of top wall 52 and/or skirt 56 of the inner cap 50 and serve to seal-in the contents of the container without need for additional liners, malleable seal materials, foil seals or other types of sealing members commonly used for seating the closure in contact with the container neck finish, as is well known in the art.

Figure 3:
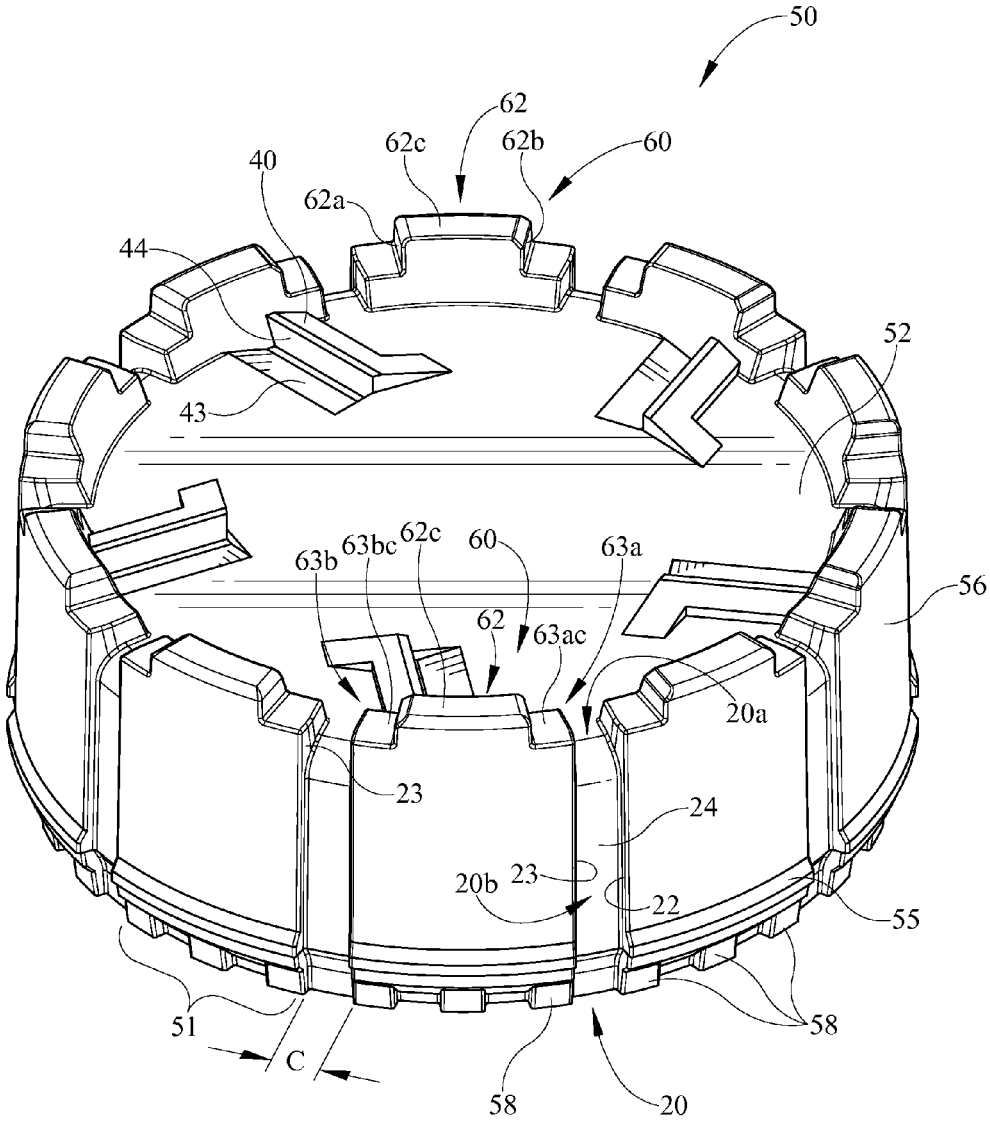
FIG. 3 is a top perspective view of the inner cap of the closure of FIG. 1.

Lugs 33 of outer cap 30 are put in operable engagement with lugs 60 of inner cap 50 when closure 10 is pushed down to become engaged with the container. When minimal force is applied downwardly to outer cap 30 while turning it in the closure-applying direction B, on-drive surface 33*b* of each outer cap lug 33 will engage each respective lug 60 of inner cap 50 to screw closure 10 onto the container neck finish. In the embodiment shown in FIGS. 1, 2, and 5-7, the on-drive surface 33*b* of each lug 33 is generally perpendicular to the plane of top wall 32, and off-drive surface 33*a* is also perpendicular to the plane of the top wall 32. As shown in FIG. 3, each of lugs 60 of inner cap 50 include a side surface 62*a* of center portion 62 that is generally perpendicular to the plane of inner cap top wall 52. Because on-drive surface 33*b* of each of lugs 33 is generally perpendicular to the plane of top wall 32, outer cap lugs 33 may easily make the necessary engagement with the generally perpendicular side surface 62*a* of inner cap lugs 60 upon application of a minimal downwardly directed force to screw closure 10 onto the container neck finish. Further, when the on-drive surface 33*b* or off-drive surface 33*a* of a lug 33 is engaged with the side surface 62*a* or 62*b* of lug 60, respectively, the bottom surface 33*c* of each lug 33 may engage and abut against adjacent upper surfaces 63*ac* and 63*bc* of each lateral portions 63*a*, 63*b*, respectively, between two adjacent lugs 60. It should be also be understood that the distance C between lateral portions 63*a* and 63*b* of two adjacent lugs is less than the distance or width between the on-drive surface 33*b* and off-drive surface 33*a* of the outer cap lug 33.

The application of a downwardly directed pushing force to outer cap 30 while turning it in the closure-removing direction A will produce an effect which depends on the magnitude of the applied force. If the force is great enough, the off-drive surfaces 33*a* of outer cap lugs 33 will be tightly engaged against side surfaces 62*b* of inner cap lug center portion 62 and the turning of the outer cap will operate to unscrew closure 10 from the container neck finish. If, on the other hand, an insufficient axial pushing force is applied to outer cap 30, as may normally occur when turned by a child, will cause the spring fingers 42 to slip over or ride over the ramps 40 and the off-drive surfaces 33*a* of lugs 33 will slide across or be axially displaced above the inner cap lugs 60. The difference in length between skirt 56 of inner cap 50 and skirt 34 of outer cap 30 allows this axial displacement to occur as successive spring fingers 42 slip over or ride over the ramps 40 without imparting a turning movement to the inner cap, thus producing the desired child resistant feature.

Child resistant lugs 33 are formed integrally with outer cap 30 adjacent the junction of top wall 32 and skirt 34. Lugs 33 correspond in number and spacing to lugs 60 on inner cap 50. Both outer cap lugs 33 and inner cap lugs 60 are annularly aligned in that the annulus on which the lugs 33 are located is approximately the same diameter as the annulus on which the lugs 60 are located. In that manner, the outer cap skirt 34 and ramps 40 form an annular zone therebetween in which the lugs 60 and lugs 33 are located. It will be understood by one skilled in the art that there are a variety of lugs, ratcheting, and/or spring mechanisms that may be used to operably engage the outer cap and inner cap in a child resistant mechanism while still providing the desired venting.

As shown in FIGS. 1 and 3-7, inner cap 50 includes one or more vent channels or recesses 20. The elongated vent channels 20 are shown as to be a substantially vertical/axial portion and a radial portion along the exterior surface of the inner cap 50. Vent channel 20 extends radially along a portion of the inner cap top wall 52 and continues axially along the inner cap skirt 56 through the distal free end of the skirt. Alternatively stated, vent channel 20 has an upper or first vent channel 20*a* above the inner cap top wall that is continuous with or in fluid communication with an axial or second vent channel 20*b*. Vent channels 20 may extend through inner cap lug 60 at a variety of positions, or more specifically through, at various depths, one or more lug lateral portions or platforms 62*a*, 63*b*. As a result, vent 20 may create one or more lug lateral portions 63*a*, 63*b* as shown between lug center portions 62 that combine to create a platform for receiving outer cap lug 33. Each vent channel 20 is recessed from the exterior surface of the inner cap skirt 56 and includes opposing sides 22, 23 with a bottom surface 24 therebetween. Sides 22, 23 of vent channel 20 may coincide with or define the lateral portions 63*a*, 63*b* between two adjacent lugs 60, two adjacent portions of retaining bead 55, and two adjacent unscrewing lugs 58. Unscrewing lugs 58 may function during the molding process to aid in removal of the cap from the mold cavities. Bottom surface 24 of second vent channel 20*b* is recessed and as a result is spaced at a smaller radial distance from the central vertical axis of inner cap 50 than the radial distance of the outermost periphery of the skirt 56 along the length of the vent channels. Further the upper end of bottom surface 24 of first vent channel 20*a* merges with the upper surface of inner cap top wall 52 and therefore is recessed between lugs 60 across a portion of the top wall. The width or distance C of each vent channel 20 (FIG. 4) is less than the length of each lug 33 of outer cap 30, whereby the lugs 33 are prevented from intruding into the vent channel between sides 22 and 23 and therefore rest upon the platform formed by adjacent lateral portions 63*a* and 63*b* of the corresponding inner cap lugs 60.

As shown in FIGS. 1 and 3-7, each vent channels 20 permits air or fluid to be evacuated from between inner cap 50 and outer cap 30. Vent channel 20 remains open (FIG. 5) to quickly evacuate fluid from the area between inner cap top wall 52 and outer cap top wall 32, and from around the skirt 56, during the vacuum leaking test, even when, as shown in FIGS. 6 and 7, the inner cap bead 55 sections are sealed against or abutted against the retaining bead 35. Although the vent channels 20 are shown in detail, the vent channels can have a variety of different configurations such as varying widths, depths, or lengths; different shapes such as curved, non-axial, or tapered; different positions; and/or different quantities, and still provide the desired fluid evacuation.

It should be also understood that the embodiment in FIGS. 1-7, could be described as a plurality of circumferential projections or sections 51 spaced about the exterior surface of inner cap 50. Each section 51 is spaced from those adjacent by a distance C, wherein distance C is less than the size or width of the outer cap lugs 33. Each section 51 extends outwardly from the upper surface of the inner cap top wall 52 and continues to extend outwardly down along the exterior skirt surface 24 along the axial length of the skirt and further continues through the distal free end of the skirt. Each section 51 may include, but is not limited to, one or more child resistant lugs 60, one or more retaining beads 55, and one or more unscrewing lugs 58. Specifically, each lug 60 projects at least axially from the upper surface of the inner cap top wall 52 and continues to project radially outward from the skirt and extends axially towards and intersects the retaining bead 55. Further, section 51 may extend below the retaining bead 55 to one or more unscrewing lugs 58 adjacent the distal free end of the skirt 56. As a result, the spacing or distance C between adjacent sections 51 allows air and fluid to evacuate between the inner cap 50 and outer cap 30.

It is understood that while certain embodiments of the invention have been illustrated and described, it is not limited thereto except insofar as such limitations are included in the following claims and allowable functional equivalents thereof.

We claim:

1. A push and turn child resistant closure comprising:

an outer cap operably disposed over an inner cap;

said inner cap having a top wall and a depending sidewall, said sidewall having an outer surface, and said top wall having an outer surface;

said inner cap having a plurality of circumferentially spaced outer peripheral sections, each one of said sections extending axially outward from said outer surface of said top wall and also extending radially outward from said outer surface of said sidewall, each one of said sections including at least one lug extending axially from said top wall outer surface and including at least one retaining bead extending radially outward at a lower distal end of said skirt thereby creating a continuous channel to evacuate fluid from between said inner cap and said outer cap; and said outer cap including a top wall and a depending sidewall, and a plurality of circumferentially spaced lugs projecting downwardly from said top wall, said sidewall having a distal free end, said distal free end of said skirt having a continuous bead projecting radially inward.

2. The push and turn child resistant closure as in claim 1 wherein each one of said sections of said inner cap includes at least one unscrewing lug positioned axially below said at least one retaining bead.

3. The push and turn child resistant closure as in claim 1 wherein said at least one lug of said section includes a center portion with opposing lateral portions, said center portion extends from said top wall at a first distance and each said lateral portions extends from said top wall at a second distance, wherein said first distance is greater than said second distance.

4. The push and turn child resistant closure as in claim 1 wherein each said section extends the entire axially length of said inner cap sidewall.

5. The push and turn child resistant closure as in claim 1 wherein a distance between two adjacent sections is substantially constant the axial length of said inner cap.

6. The push and turn child resistant closure as in claim 1 wherein one of said inner cap and said outer cap includes a plurality of spring fingers.

7. A child resistant closure comprising:

an inner cap operably engaging an outer cap, wherein said outer cap includes a top wall and a peripheral outer cap skirt, and a first plurality of child resistant lugs, said outer cap skirt having a distal free end, said distal free end of said outer cap skirt having a continuous bead projecting radially inward;

said inner cap including a top wall and a peripheral inner cap skirt, and a second plurality of child resistant lugs, said inner cap skirt has an outer surface with a discontinuous bead projecting radially outward therefrom at a distal free end of said inner cap skirt, said discontinuous bead engaging with said outer cap continuous bead to axially retain said inner cap within said outer cap, said inner cap skirt having at least one longitudinal channel recessed radially inward from said outer surface of said inner cap skirt and extending between two adjacent portions of said discontinuous bead projecting from said inner cap skirt and extending from said distal free end to said inner cap top wall;

a spring mechanism between said inner cap and outer cap maintaining operable axial displacement therebetween to facilitate operation of said first and second plurality of child resistant lugs; and said longitudinal channel being in an open position when said discontinuous bead of said inner cap is engaged with said continuous bead of said outer cap thereby providing fluid communication into and out of said child resistant closure from between said inner cap and said outer cap.

8. The child resistant closure of claim 7 further including at least one radial channel radially extending across a portion of said inner cap top wall.

9. The child resistant closure of claim 7 wherein said spring mechanism includes one or more spring fingers.

10. The child resistant closure of claim 7 wherein said second plurality of child resistant lugs project upwardly from an outer periphery of said inner cap top wall.

11. The child resistant closure of claim 7 wherein said second plurality of child resistant lugs upwardly projects from an outer periphery of said inner cap top wall and includes a platform between two adjacent said lugs of said second plurality of child resistant lugs, wherein one of said first plurality of child resistant lugs engages said platform when said outer cap is in an off-drive position with said inner cap.

12. The child resistant closure of claim 11 wherein a radial channel extends through said platform between said two adjacent lugs of said second plurality of child resistant lugs.

13. The child resistant closure of claim 7 wherein said inner cap skirt further includes a plurality of unscrewing lugs spaced about a periphery of said inner cap skirt distal end beneath said discontinuous bead, wherein said longitudinal channel extends between two adjacent unscrewing lugs.

14. The child resistant closure of claim 7 further includes a sealing member within said inner cap.

15. A child resistant closure comprising:

an inner cap nested into an outer cap with a spring mechanism yieldingly urging said outer cap away from said inner cap;

said outer cap includes a top wall and a skirt, and a plurality of circumferentially spaced lugs projecting downwardly from said top wall, said skirt having a distal free end, said distal free end of said skirt having a continuous bead projecting radially inward;

said inner cap having a top wall with a depending skirt, said top wall having an upper surface, and a plurality of circumferentially spaced lugs projecting upwardly from said top wall upper surface, each said lug having a raised center portion extending a first distance from said top wall upper surface and at least one lateral portion extending a second distance from said top wall upper surface, wherein said first distance is larger than said second distance, a first recessed vent radially extending through said at least one lateral portion of at least one said lug;

said inner cap depending skirt having an outer periphery surface, said outer periphery surface of said inner cap depending skirt having a second recessed vent axially extending from a distal free end of said skirt to said inner cap top wall, wherein said second recessed vent axially extends through a retaining bead at said distal free end of said skirt whereby an outer periphery of said retaining bead is discontinuous; and said first recessed vent and said second recessed vent are in fluid communication.

16. The child resistant closure as in claim 15 wherein said distal free end of said inner cap skirt includes a plurality of unscrewing lugs, said second recessed vent axially extends between two adjacent said unscrewing lugs.

17. The child resistant closure as in claim 15 wherein said first recessed vent radially extends through said at least one lateral portion of said at least one lug at a depth of said second distance.

18. The child resistant closure as in claim 15 wherein said first recessed vent has a width that is smaller than a width of each said lug of said outer cap.

19. The child resistant closure as in claim 15 wherein each said lug of said inner cap has two of said at least one lateral portions on opposing sides of said center portion of said lug.

20. The child resistant closure as in claim 15 wherein each one of said first recessed vent and said second recessed vent have the same width.

* * * * *